US005707790A

United States Patent [19]

Yanagisawa

[11] Patent Number: 5,707,790

[45] Date of Patent: Jan. 13, 1998

[54] DEVELOPING COMPOSITION FOR SILVER HALIDE PHOTOGRAPHIC LIGHT-SENSITIVE MATERIAL

[75] Inventor: Hiroyuki Yanagisawa, Hino, Japan

[73] Assignee: Konica Corporation, Japan

[21] Appl. No.: 811,824

[22] Filed: Mar. 5, 1997

[30] Foreign Application Priority Data

Mar. 11, 1996 [JP] Japan ..... 8-053011
Jul. 26, 1996 [JP] Japan ..... 8-197497

[51] Int. Cl.[6] ..... G03C 5/305

[52] U.S. Cl. ..... 430/480; 430/440; 430/465; 430/488; 430/491

[58] Field of Search ..... 430/440, 480, 430/488, 491

[56] References Cited

U.S. PATENT DOCUMENTS 5,098,819 3/1992 Knapp ..... 430/491
5,399,457 3/1995 Davies et al. ..... 430/488
5,648,205 7/1997 Okutsu ..... 430/488

*Primary Examiner*—Hoa Van Le
*Attorney, Agent, or Firm*—Jordan B. Bierman; Bierman, Muserlian and Lucas LLP

[57] ABSTRACT

A developing composition for a silver halide black-and-white photographic light sensitive material is disclosed, comprising a compound represented by formula (1) and a compound represented by formula (2) or (3):

formula (1)

formula (2)

formula (3)

6 Claims, No Drawings

DEVELOPING COMPOSITION FOR SILVER HALIDE PHOTOGRAPHIC LIGHT-SENSITIVE MATERIAL

FIELD OF THE INVENTION

The present invention relates to a developing composition for a silver halide black-and-white photographic light sensitive material and a processing method by use thereof.

BACKGROUND OF THE INVENTION

In processing of a silver halide photographic light sensitive material (hereinafter, referred to as a photographic material) for use in medical diagnosis, dihydroxybenzenes such as hydroquinone have conventionally been used as a developing agent. A developing solution containing these dihydroxybenzenes further requires that it contains a sulfite as a preserving agent. It is also not preferred, in terms of safety in the lab environment, and further the developing solution is likely to discolor due to air oxidation, causing discoloring stain.

Instead of the dihydroxybenzenes, there is known a technique of using reductones as a developing agent. The reductones cause no stain due to air oxidation, and since ascorbic acid and erythorbic acid are used as a food additive, they are biologically benign and widely available. However, a developing solution containing a reductone is liable to rapid oxidation under alkaline conditions, liberating an acid upon hydrolysis, which lowers the pH of the developing solution. As a result, its major disadvantage is great variance of sensitivity of the photographic material.

In processing of the photographic material, a developing solution or a fixing solution is often contaminated with calcium ions, which form a precipitate of calcium carbonate or calcium sulfite upon reaction with a carbonate or sulfite in the solution, causing smudging of the processed film.

The precipitate easily adheres to the walls of the processing bath tank and the transporting roller, causing scumming of the processed film (so-called sludge defect). To prevent such scum, there is known a technique using a chelating agent such as ethylenediaminetetraacetic acid (EDTA) or nitrilotriacetic acid (NTA). However, chelates of these compounds with traces of iron ions or copper ions contained in the solution adversely accelerate air oxidation of the developing agent. Contamination of the fixing bath with calcium ions also causes sludge defect of the fixing bath tank and a transporting rollers.

Since EDTA is low in biodegradability and is not ecologically friendly, recently, in some regions, there is a trend of limiting its usage to protect environment.

Since 1995, disposal of photographic processing effluent in the oceans has been prohibited and incineration is more prevalent. The treatment of the processing effluent results in an increase of energy and cost, and in an effort to reduce the processing effluent, there has been a tendency to reducef replenishing amounts. However, a major disadvantage of reduction of the processing effluent is that renewal of the processing solution is retarded, causing oxidation-induced exhaustion of the processing solution, which leads to lowering the density and contrast of a processed photographic material and further deteriorates the process stability.

At the present, almost all photographic processing solutions are commercially available as concentrated solutions, which can be used simply by dilution with water. However, the concentrated solution are quite heavily and bulky and problems concerning transportation cost and work hazards are additionally shortcomings. Accordingly, photographic processing at a relatively low replenishment, which results in negligible variation of photographic performance (e.g., sensitivity, contrast, fog, etc.) and reduction of sludge, which does not adversely affect ecology, has been eagerly sought.

SUMMARY OF THE INVENTION

An object of the present invention is to provide a processing composition and a processing method by use thereof, which is superior in anti-air-oxidation, low variation of photographic performance (sensitivity, contrast, fog, etc.) does not cause sludge defects in the presence of metal ions and overcomes excessive transportation costs and poses no hazards to working environment.

The above object of the invention can be accomplished by the following constitution.

1. A developing composition for a silver halide black-and-white photographic light sensitive material comprising a compound represented by formula (1) and a compound represented formula (2) or (3).

Formula (1)

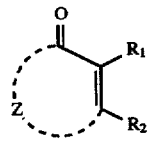

In the formula, $R_1$ and $R_2$ are each a hydroxy group, mercapto group, a substituted or unsubstituted amino group, a substituted or unsubstituted acylamino group, a substituted or unsubstituted alkylsulfonylamino group, a substituted or unsubstituted arysulfonylamino group, a substituted or unsubstituted alkoxycarbonylamino group, or a substituted or unsubstituted alkylthio group: Z is an atomic group necessary for forming a substituted or unsubstituted 5 or 6-membered carbon ring or a substituted or unsubstituted 5 or 6-membered heterocyclic ring and the carbon or heterocyclic ring may form a substituted or unsubstituted, condensed ring.

Formula (2)

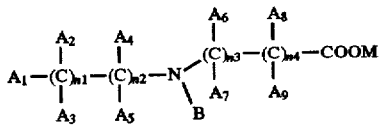

In the formula, B is a hydrogen atom or OH; in the case where B is a hydrogen atom, $A_1$ through $A_9$ is a hydrogen atom, OH, $C_nH_{2n+1}$ or $(CH_2)_mX$, in which n is an integer of 1 to 3, m is an inter of 0 to 3 and X is $COOM_1$, $NH_2$ or OH, $n_1$ and $n_2$ are each 1 and $n_3$ plus $n_4$ is an integer of 1 to 4, provided that all of $A_1$ to $A_5$ are not hydrogen atoms; in the case where B is OH, $n_1$ and $n_2$ are each an integer, provided that $n_1$ plus $n_2$ is 2, $n_3$ is 0, and $n_4$ is 1, $A_1$, $A_8$ and $A_9$ are each a hydrogen atom, $A_2$ through $A_5$ are each a hydrogen atom, OH, $COOM_1$, $PO_3(M_1)_2$, $CH_2COOM_1$, $CH_2OH$ or an lower alkyl group, provided that at least one of $A_2$ through $A_5$ is $COOM_1$, $PO_3(M_1)_2$ or $CH_2COOM_1$; M and $M_1$ are each a hydrogen atom, an alkali metal atom or an ammonium group.

Formula (3)

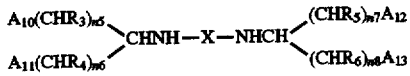

In the formula, $A_{10}$ through $A_{13}$ are each $COOM_2$ or OH; $n_5$ through $n_8$ are each an integer of 0 to 3; $R_3$ through $R_6$ are each a hydrogen atom, OH or a lower alkyl group having 1 to 5 carbon atoms; X is an alkylene group having 2 to 6 carbon atoms or $=(B_1O)_{m1}—B_2—$, in which $B_1$ and $B_2$ are each an alkylene group and $m_1$ is an integer of 1 to 5; $M_2$ is a hydrogen atom, an alkali metal atom or an ammonium group.

2. A photographic fixing composition comprising a compound represented by above-described formula (2) or (3).

3. A method for processing a silver halide black-and-white photographic light sensitive material, characterized in that said photographic material is processed with a developing solution containing a compound represented by formula (1) and a compound represented by formula (2) or (3), and a fixing solution containing a compound represented by formula (2) or (3).

4. The processing method described above, characterized in that said photographic material is developed with replenishing a developer-replenishing solution containing a compound represented by formula (1) and a compound represented by formula (2) or (3).

5. The processing method described in above 3 and 4, characterized in that the pH of the developing solution is 9.5 to 10.5, the pH of the developer-replenishing solution being 10.0 to 11.0.

6. A solid developing composition for a silver halide black-and-white photographic light sensitive material, comprising a compound represented by formula (1) described above and a compound represented by formula (2) or (3) described above.

7. The processing method described in above 3 to 5, characterized in that said developer-replenishing solution is prepared by dissolving said solid developing composition in water.

8. A solid fixing composition for a silver halide black-and-white photographic light sensitive material, comprising a compound represented by formula (2) or (3) described above.

9. The processing method described in above 3, characterized in that a fixer-replenishing solution is prepared by dissolving said solid fixing composition in water.

10. The developing composition described in above 1, characterized in that among optical isomers of the compound represented by formula (2) or (3), a [S,S] isomer is selectively used.

11. The fixing composition described in above 3, characterized in that among optical isomers of the compound represented by formula (2) or (3), a [S,S] isomer is selectively used.

12. The processing method described in above 3, 4, 5, 7 or 9, characterized in that among optical isomers of the compound represented by formula (2) or (3), a [S,S] isomer is selectively used.

13. The solid developing composition described in above 6, characterized in that among optical isomers of the compound represented by formula (2) or (3), a [S,S] isomer is selectively used.

14. The solid fixing composition described in above 8, characterized in that among optical isomers of the compound represented by formula (2) or (3), a [S,S] isomer is selectively used.

DETAILED DESCRIPTION OF THE INVENTION

In formula (1), $R_1$ and $R_2$ are each a hydroxy group, mercapto group, a substituted or unsubstituted amino group, a substituted or unsubstituted acylamino group, a substituted or unsubstituted alkylsulfonylamino group, a substituted or unsubstituted arysulfonylamino group, a substituted or unsubstituted alkoxycarbonylamino group, or a substituted or unsubstituted alkylthio group: Z is an atomic group necessary for forming a substituted or unsubstituted 5 or 6-membered carbon ring or a substituted or unsubstituted 5 or 6-membered heterocyclic ring and the carbon or heterocyclic ring may form a substituted or unsubstituted, condensed ring.

The compound represented by formula (1) is generally known as a reductone. $R_1$ and $R_2$ are each a hydroxy group, mercapto group, an amino group (including one having, as a substituent, an alkyl group having 1 to 10 carbon atoms such as methyl, ethyl, n-butyl and hydroxyethyl), an acylamino group (e.g., acetylamino group, benzoylamino group, etc.), an alkylsulfonylamino group (e.g., methanesulfonylamino group, etc.), an arysulfonylamino group (e.g., benzenesulfonylamino group, p-toluenesulfonylamino group, etc.), an alkoxycarbonylamino group (e.g., methoxycarbonylamino group, ethoxycarbonylamino group, etc.), or an alkylthio group (e.g., methylthio group, ethylthio group, etc.).

$R_1$ and $R_2$ are preferably a hydroxy group, amino group, alkylsulfonylamino group or arylsulfonylamino group. Z is an atomic group necessary for forming a substituted or unsubstituted 5 or 6-membered carbon ring or a substituted or unsubstituted 5 or 6-membered heterocyclic ring, and the carbon or heterocyclic ring may form a substituted or unsubstituted, condensed ring.

As examples of the atomic group constituting Z are cited one constituted by a combination of —O—, $—C(R_7)(RR_8)—$, $—C(R_9)=$, —C(=O)—, $—N(R_{10})—$ and —N=, in which $R_7$, $R_8$, $R_9$ and $R_{10}$ are each a hydrogen atom, substituted or unsubstituted alkyl group having 1 to 10 carbon atoms (examples of substituents including a hydroxy group, carboxy group and sulfo group), a substituted or unsubstituted aryl group having 6 to 15 carbon atoms (examples of substituents including an alkyl group, halogen atom, hydroxy group, carboxy group or sulfo group), a hydroxy group or a carboxy group.

The 5 or 6-membered ring may form saturated or unsaturated condensed ring. Examples of the 5 or 6-membered ring include a dihydroxyfuranone ring, dihydropyrone ring, pyranone ring, cyclopentenone ring, cyclohexanone ring, pyrrolinone ring, pyrazolinone ring, pyridone ring, azacyclohexanone ring, and uracil ring. Among these, dihydroxyfuranone ring, cyclopentenone ring, cyclohexanone ring, pyrazolinone ring, azacyclohexanone ring, and uracil ring are preferred.

Exemplary examples of the compound represented by formula (1) are shown as below, but the present invention is not limited thereto.

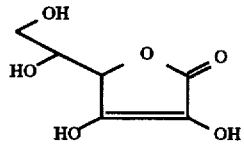

1-1

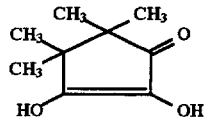

1-2

-continued
1-3
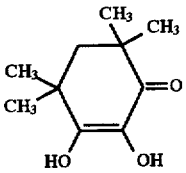
1-4
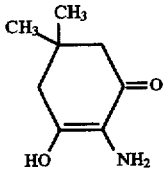
1-5
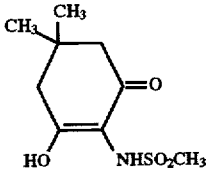
1-6
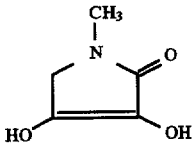
1-7
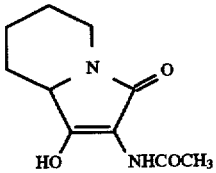
1-8
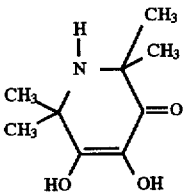
1-9
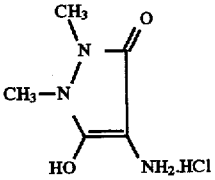
1-10
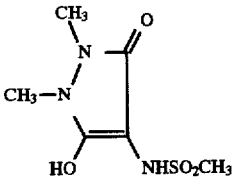
-continued
1-11
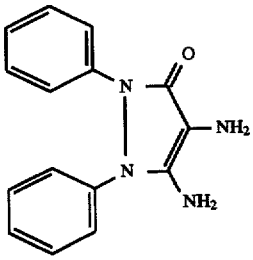
1-12
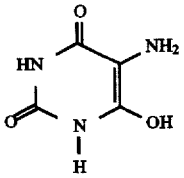
1-13
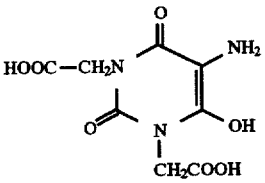
1-14
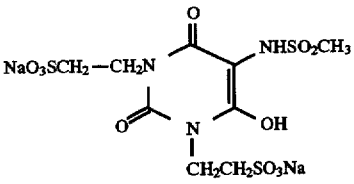
1-15
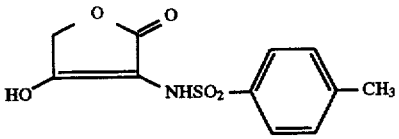
1-16
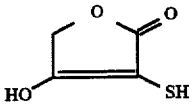
1-17
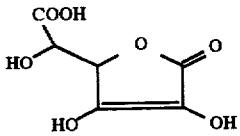
1-18
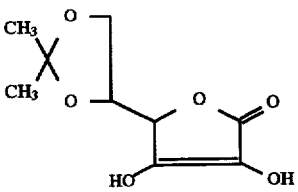
1-19
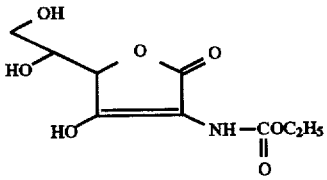

-continued

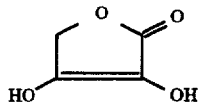

1-20

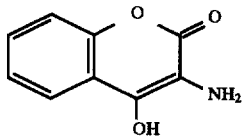

1-21

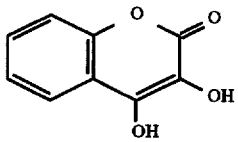

1-22

These compounds are commercially available or can be readily synthesized according to known methods. Among above exemplified compounds, ascorbic acid (exemplified compound 1-1), its salts (e.g., sodium, potassium or lithium salts), and its optical isomer, erythorbic acid including its salts are preferred.

The reductone is preferably contained in an amount of 5 to 100, more preferably, 10 to 50 g per liter of a developing solution. In case of less than 5 g/l, sufficient development is not attained and in case of more than 100 g/l, process stability with time is deteriorated.

In formula (2), B is a hydrogen atom or OH; in the case where B is a hydrogen atom, $A_1$ through $A_9$ is a hydrogen atom, OH, $C_nH_{2n+1}$ or $(CH_2)_mX$, in which n is an integer of 1 to 3, M is an inter of 0 to 3 and X is $COOM_1$, $NH_2$ or OH, $n_1$ and $n_2$ are each 1 and $n_3$ plus $n_4$ is an integer of 1 to 4, provided that all of $A_1$ to $A_5$ are not hydrogen atoms; in the case where B is OH, $n_1$ and $n_2$ are each an integer, provided that $n_1$ plus $n_2$ is 2, $n_3$ is 0, and $n_4$ is 1, $A_1$, $A_8$ and $A_9$ are each a hydrogen atom, $A_2$ through $A_5$ are each a hydrogen atom, OH, $COOM_1$, $PO_3(M_1)_2$, $CH_2COOM_1$, $CH_2OH$ or an lower alkyl group having 1 to 5 carbon atoms (e.g., methyl, ethyl, iso-propyl butyl pentyl), provided that at least one of $A_2$ through $A_5$ is $COOM_1$, $PO_3(M_1)_2$ or $CH_2COOM_1$; M and $M_1$ are each a hydrogen atom, an alkali metal atom (e.g., Li, Na, K etc.) or an ammonium group.

In formula (3), $A_{10}$ through $A_{13}$ are each $COOM_2$ or OH; $n_5$ through $n_8$ are each an integer of 0 to 3; $R_3$ through $R_6$ are each a hydrogen atom, OH or a lower alkyl group having 1 to 5 carbon atoms (e.g., methyl, ethyl, iso-propyl, butyl, pentyl); X is an alkylene group having 2 to 6 carbon atoms or $=(B_1O)_{m1}—B_2—$, in which $B_1$ and $B_2$ are each an alkylene group having 1 to 5 carbon atoms (e.g., methylene, ethylene, propylene, butylene, pentylene) and $m_1$ is an integer of 1 to 5; $M_2$ is a hydrogen atom, an alkali metal atom (e.g., Li, Na, K) or an ammonium group.

Exemplary examples of compounds represented by formulas (2) and (3) (hereinafter, referred to as a chelating agent) are shown below, but the present invention is not limited thereto.

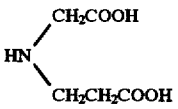

2-1

-continued

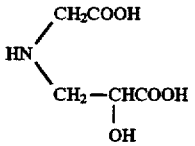

2-2

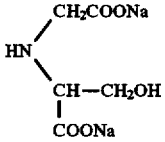

2-3

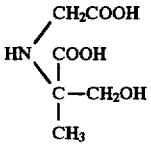

2-4

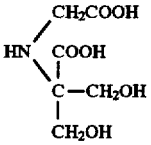

2-5

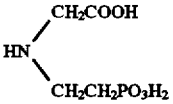

2-6

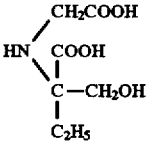

2-7

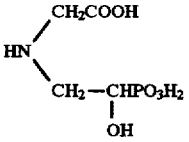

2-8

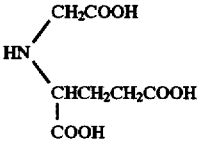

2-9

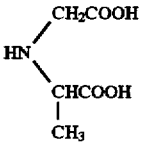

2-10

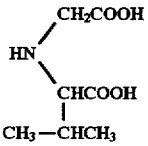

2-11

-continued
2-12
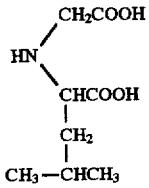
2-13
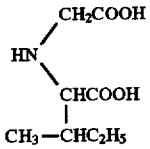
2-14
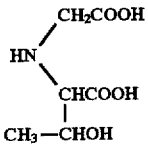
2-15
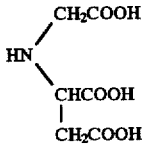
2-16
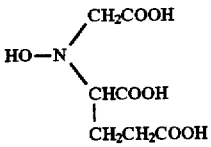
2-17
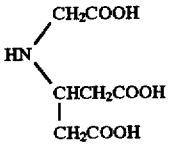
2-18
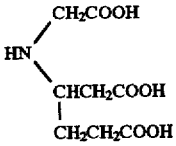
2-19
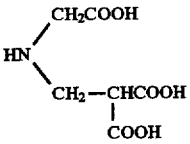
2-20
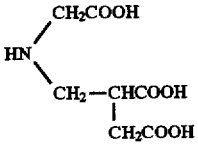
2-21
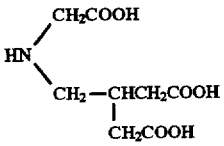
-continued
2-22
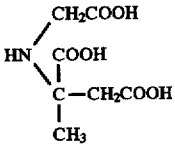
2-23
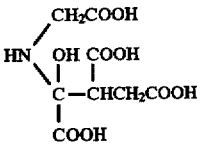
2-24
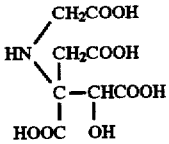
2-25
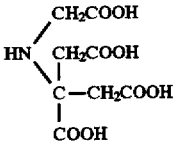
2-26
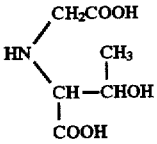
2-27
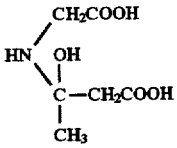
2-28
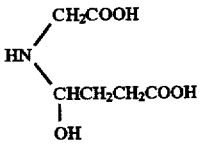
2-29
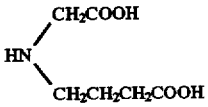
2-30
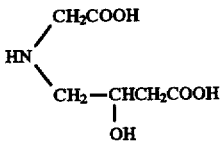
2-31
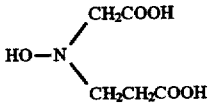
2-32
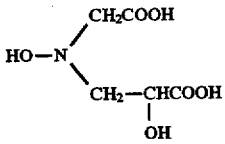

-continued
2-33
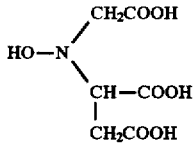
2-34
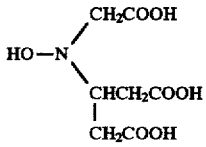
2-35
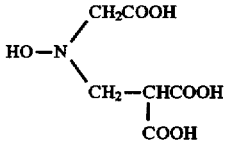
2-36
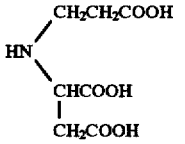
2-37
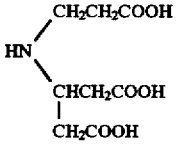
2-38
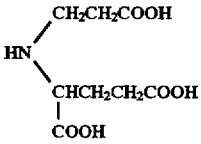
2-39
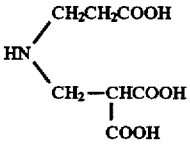
2-40
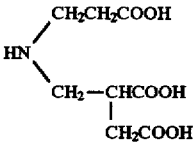
2-41
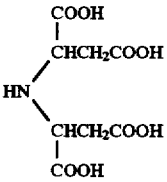
2-42
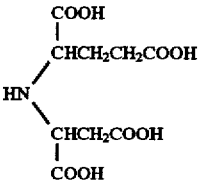
-continued
2-43
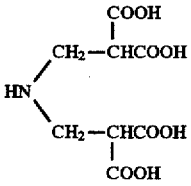
2-44
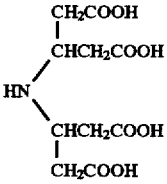
2-45
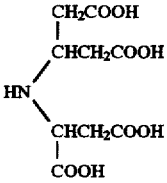
2-46
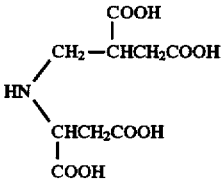
2-47
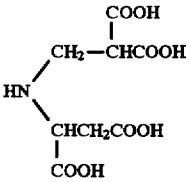
2-48
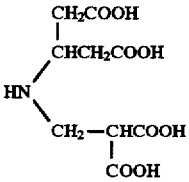
2-49
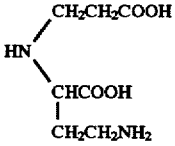
2-50
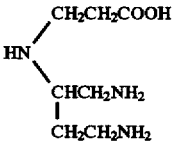
2-51
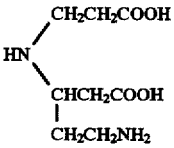

-continued
2-52
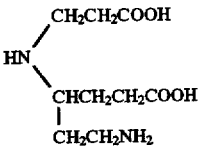
2-53
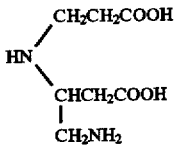
2-54
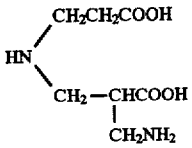
2-55
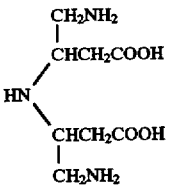
2-56
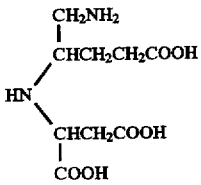
2-57
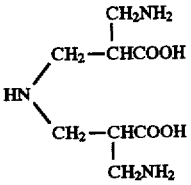
2-58
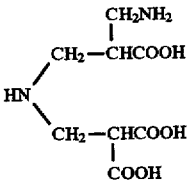
2-59
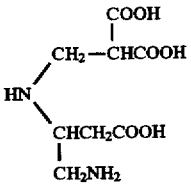
2-60
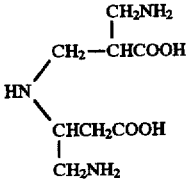
-continued
2-61
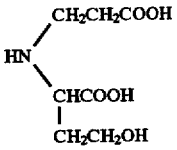
2-62
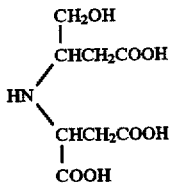
3-1
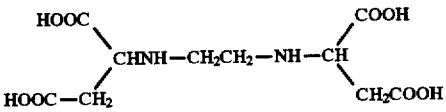
3-2
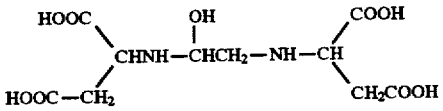
3-3
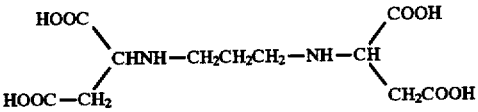
3-4
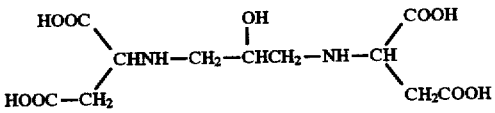
3-5
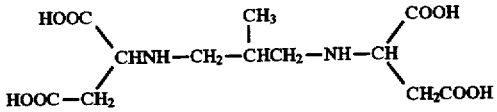
3-6
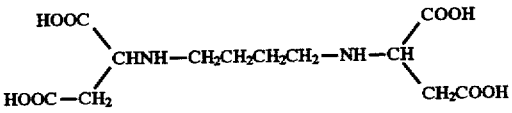
3-7
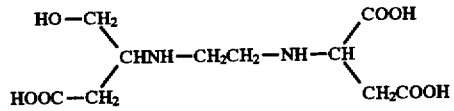
3-8
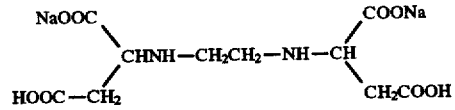
3-9
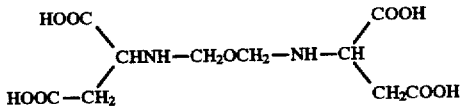
3-10
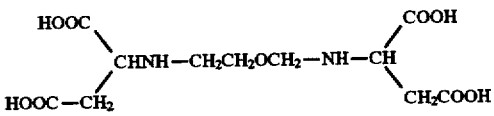
3-11
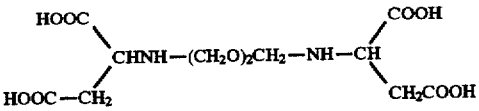

-continued 3-12

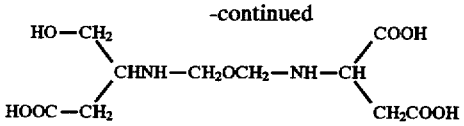

3-13

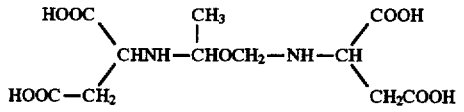

3-14

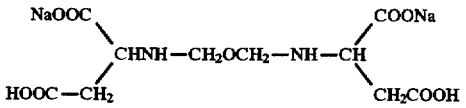

3-15

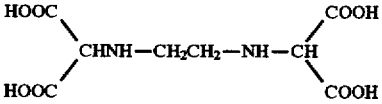

3-16

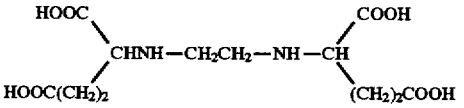

3-17

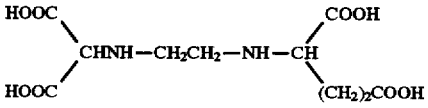

3-18

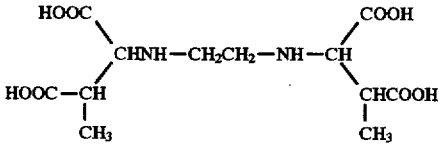

3-19

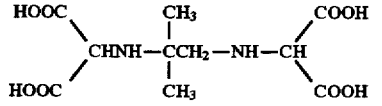

3-20

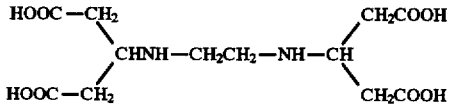

3-21

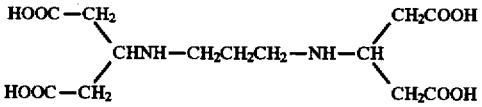

3-22

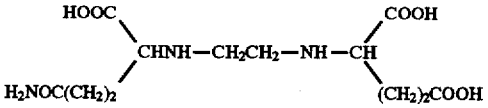

3-23

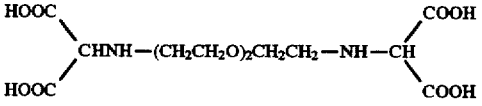

3-24

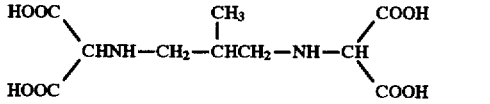

3-25

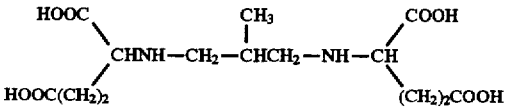

-continued 3-26

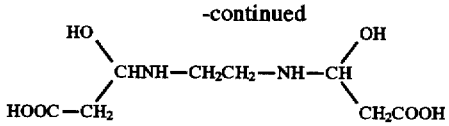

3-27

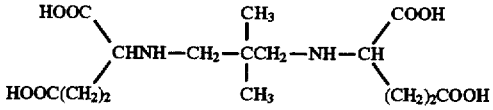

3-28

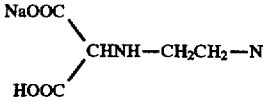

3-29

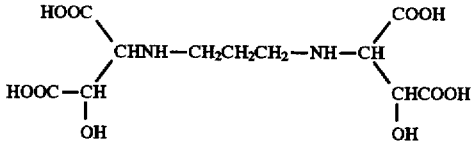

3-30

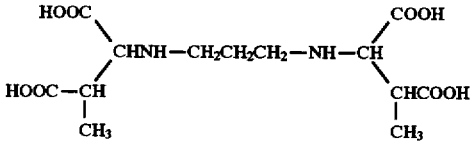

3-31

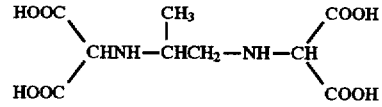

3-32

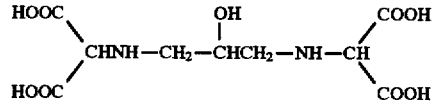

3-33

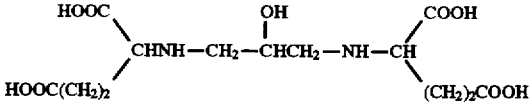

3-34

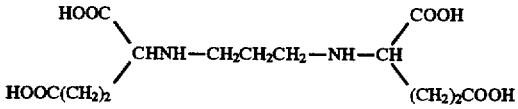

3-35

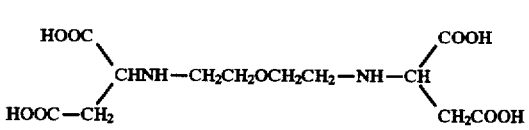

3-36

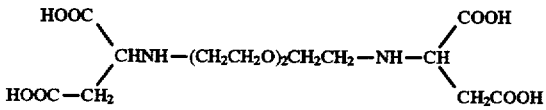

The compounds represented by formulas (2) and (3) are commercially available or can be readily synthesized according to methods described in JP-A 63-199295 and 3-173857 (herein, the term, "JP-A" means unexamined, published Japanese Patent Application).

The compound represented by formula (2) or (3) includes its optical isomers, such as [S,S] isomer, [S,R] isomer, [R,S] isomer and [R,R] isomer. For example, exemplified compound 3-1 may be a [S,S] isomer, [S,R] isomer or [R,R] isomer, or a mixture of these optical isomers. Herein, the notation, "[S,S], [S,R], [R,S] and [R,R]" is based on the Cahn-Ingold-Prelog system, as well known in the art [Cahn, Ingold, and Prelog, Angew. Chem. Intern. Ed. Engl. 5, 385–415 (1966)].

Among these isomers, the selective use of [S,S] isomer is preferred for the purpose of reducing sludge defects. These optical isomers are preferably made from corresponding L-amino acids. The [S,S] isomer is preferred in view of being readily biodegradable. Herein, the expression, "selective use of [S,S] isomer" means the use of mixed isomers, in which the [S,S] isomer accounts for not less than 70% (preferably, not less than 90%) of the isomers. Selective synthesis of the [S,S] isomer is referred to Umezawa et al., Journal of Antibiotics Vol. XXXVI No.4, pp.426 (April 1984).

The compound represented by formula (2) or (3) is preferably contained in a developing solution, in amount of 0.005 to 0.1, more preferably, 0.01 to 0.05 mol/l. In case of less than 0.005 mol/l, preservability of the developing solution is lowered and process stability is deteriorated. Contrarily, in case of more than 0.1 mol/l, developability becomes poor and contrast is lowered. The compound represented by formula (2) or (3) may be contained in a fixing solution in an amount sufficient for chelating metal ions. Thus, it is preferably 0.005 to 0.1 mol/l, more preferably, 0.01 to 0.05 mol/l. The compound represented by formula (2) or (3) may be contained in combination thereof, provided that the total amount thereof is within the range as described above.

The pH of a developing solution is preferably 9.5 to 10.5. In case of less than 9.5, developability is poor and sufficient density and contrast are not obtained. In contrast, in case of more than 10.5, pH variation with time is marked, leading to deterioration in process stability and increase of fog density.

As to replenishment of the developing solution and fixing solution, a replenishing solution which is prepared by dissolving in water a solid replenishing composition relating to invention in a replenishing tank, is supplied based on replenishing information. The replenishing amount is preferably 50 to 200 ml/m$^2$.

As a embodiment of the invention, the developing composition or fixing composition relating to the invention is in the form of solid. The developing or fixing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer, as described in JP-A 4-29136, 4-85533, 4-85534, 4-85535, 4-85536 and 4-172341.

Further, the solid developing composition or solid fixing composition is preferably in the form of a tablet. A preferred tablet-making process is to form a tablet by compression-molding after granulating powdery processing composition. As compared to a solid composition prepared simply by mixing the processing composition to form a table, there is an advantage that improvements in solubility and storage stability were achieved and resultingly, the photographic performance becomes stable.

As for granulation process which is carried out prior to tablet-making process, any conventionally known method such as fluidized-bed granulation process, extrusion granulation process, compression granulation process, crush granulation process, fluid layer granulation process, and spray-dry granulation process can be employed. It is preferred that the average grain size of the granules is 100 to 800 μm and preferably 200 to 750 μm. In particular, 60% or more of the granules is with a deviation of ±100 to 150 μm. When the grain size smaller, it tends to cause localization of mixing elements and therefore, is undesirable. As hydraulic press machine, any conventional compression molding machine, such as a single-engine compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side. It is further preferred to granulate separately each component, such as an alkali agent, reducing agent and preservative in the above process.

The solid developing or fixing composition in the form of a tablet can be prepared according to methods, as described in JP-A 51-61837, 54-155038, 52-88025, and British Patent 1,213,808. The granular processing composition can also be prepared according to methods, as described in JP-A 2-109042, 2-109043, 3-39735 and 3-39739. The powdery processing. composition can be prepared according to methods, as described in JP-A 54-133332, British Patent 725,892 and 729,862 and German Patent 3,733,861.

In the case of the solid developing or fixing composition being in the form of a tablet, its bulk density is preferably 1.0 to 2.5 g/cm$^3$ in terms of solubility and effects of the invention. When being not less than 1.0 g/cm$^3$, it is advantageous for strength of the solid composition; and when being not more than 2.5 g/cm$^3$, it is advantageous for solubility. In the case of the developing or fixing composition in the form of granules or powder, its bulk density is preferably 0.40 to 0.95 g/cm$^3$.

The solid developing or fixing composition can be used as not only a developer or fixer but also a photographic processing chemicals such as a rinsing agent. Particularly when used as a developer, effects of stabilizing photographic performance are marked.

A processing chemical having at least a part solidified and a solid processing chemical each applicable to the invention are included in the scope of the invention. It is, however, preferable that the whole component of these processing chemicals are solidified. It is also preferable that the components thereof are each molded into a separate solid processing chemical and then individually packed in the same form. It is further preferable that the components are packed in series in the order of periodically and repeatedly adding them from the packages.

It is preferable that all the processing chemicals are solidified and are then replenished to the corresponding processing tanks so as to meet the information on a processing amount. When an amount of replenishing water is required, it is replenished in accordance with an information on a processing amount or another information on the replenishing water control. In this case, the liquids to be replenished to a processing tank can only be replenishing water. In other words, when a plurality of processing tanks are required to be replenished, the tanks for reserving some replenishing liquids can be saved to be only a single tank by making use of replenishing water in common, so that an automatic processor can be made compact in size. In particular for making the automatic processor compact in size, it is preferable to put a water replenishing tank to the outside of the automatic processor.

The developing solution used in the invention may contain, as a preservative, an organic reducing agent as well as a sulfite described in JP-A 6-138591. Further, a bisulfite adduct of a hardening agent described in Japanese Patent Application No. 4-586323 is also usable. Compounds described in JP-A 5-289255 and 6-308680 (general formulas 4-a and 4-b) may be contained as an antisludging agent. Addition of a cyclodextrin compound is preferred, particularly as described in JP-A 1-124853.

An amine compound may be added to the developing solution, as described in U.S. Pat. No. 4,269,929.

A buffering agent may be used in the developing solution, including sodium carbonate, potassium carbonate, potassium bicarbonate, trisodium phosphate, tripotassium phosphate, dipotassium phosphate, sodium borate, potassium borate, sodium tetraborate, potassium tetraborate, sodium o-hydroxybenzoate (sodium salicylate), potassium o-hydroxybenzoate (potassium salicylate), sodium 5-sulfo-2-hydroxybenzoate (sodium salicylate) and potassium 5-sulfo-2-hydroxybenzoate (potassium salicylate).

Thioether compounds, p-phenylenediamine compounds, quaternary ammonium salts, p-aminophenols, amine compounds, polyalkylene compounds; 1-phenyl-3-pyrazolidones; hydrazines, mesoion type compound and imidazoles may be added as a development accelerating agent.

Alkali metal halides such as potassium iodide are used as a antifoggant. Organic antifoggants include benzotriazole, 6-nitrobenzimidazole, 5-nitrobenzimidazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, adenine and 1-pheny-5-mercaptotetrazole.

Furthermore, various additives such as an antistaining agent, antisludging agent and interlayer effect-accelerating compound are optionally added.

It is preferred to add a starter prior to processing. A solidified starter is also preferred. An organic acid such as polycarboxylic acid compound, alkali earth metal halide, organic restrainer or development accelerator is used as a starter.

A fixing agent, chelating agent, pH buffering agent, hardening agent and preservative known in the art can be added into a fixing solution, as described JP-A 4-242246 and 5-113632. A chelating agent, as a hardener or a bisulfite adduct of a hardener, as described in Japanese Patent Application 4-586323 is also usable in the fixing solution.

The fixing solution used in the invention contains a fixing agent such as sodium thiosulfate and ammonium thiosulfate. Ammonium thiosulfate is preferred in terms of a fixing speed. The fixing agent is generally contained in an amount of 0.1 to 6 mol/l. The fixing solution may contain a water soluble aluminum salt as a hardening agent, including aluminum chloride, aluminum sulfate and potassium alum. Further, malic acid, tartaric acid, citric acid, gulconic acid or their derivatives may be added singly or in combination. The addition amount thereof is 0.01 mol or more, specifically, 0.05 to 0.3 mol per liter of the fixing solution.

The pH of the fixing solution is 3.8 or more, preferably, 4.2 to 7.0. Taking into account of fixer-hardening or odor of bisulfites, the pH within a range of 4.3 to 4.8 is preferred. Further, the fixing solution may contain a pH buffering agent, hardening agent and preservative. Furthermore, a bisulfite adduct as a hardening agent or known fixation-accelerating agent may be added.

After being developed and fixed, the photographic material is subjected to washing or stabilization. Washing or stabilizing at a replenishing rate of not more than 3 liter per $m^2$ makes not only possible to save water but also unnecessary piping for an automatic processor.

In the case when washing is conducted with a small amount of water, a washing bath with a squeegee roller is preferably provided, as disclosed in JP-A 63-18350 and 62-287252. In this case, a variety of antioxidants or filter-filtration may be combined for pollution abatement. By supplying a replenisher containing a anti-fungal agent to a washing or stabilizing bath, a part or all of overflow or effluent from the bath may be used for a prior process of fixing.

A water soluble surfactant or defoaming agent may be added for the purpose of preventing non-uniformity due to water bubbles and/or preventing a processing chemical component adhered to the squeegee roller from transferring to a processed film. As described in JP-A 63-163456, a dye-adsorbent may be provided in the washing bath to prevent stain due to dye leached out of the photographic material. The photographic material may be washed, followed by stabilizing. In this case, a bath containing compounds described in JP-A 2-201357, 2-132435, 1-102553 and 46-44446 may be employed as a final bath, in which an ammonium compound, a compound of a metal such as Bi or Al, brightener, pH-adjusting agent, hardening agent, anti-mold, alkanol amine or surfactant is optionally contained.

As water used in washing or stabilizing process, tap water, deionized water, or water treated with a UV lamp or various oxidizing agents (e.g., ozone, hydrogen peroxide, chlorate, etc.) is usable.

EXAMPLES

Embodiments of the present invention are explained based on the following examples, but the invention is not limited thereto.

Example 1

Preparation of developing solution

A concentrated developer solution was prepared according to the following formula for 1 liter of developing solution.

| | |
|---|---|
| A-part: | |
| Water | 120 g |
| Potassium sulfite (50% aq. solution) | 190 g |
| Sodium hydrogencarbonate | 20 g |
| Boric acid | 20 g |
| Chelating agent as shown in Table 2 | |
| 1-Phenyl-5-mercaptotetrazole | 50 mg |
| 5 -Methylbenzotriazole | 150 mg |
| Developing agent (exemplified compd. 1-1) | 30 g |
| Potassium hydroxide | 70 g |
| B-part: | |
| Acetic acid (90% aq. solution) | 20 g |
| Triethylene glycol | 3 g |
| N-acetyl-D,L-penicilamine | 0.2 g |
| Water | 10 g |
| C-part: | |
| Glutar aldehyde | 4 g |
| Water | 14 g |

Parts A, B and C were mixed and tap water was further added thereto to make 1 liter and the pH was adjusted to 10.14 using acetic acid or potassium hydroxide to make a developing solution, which was also employed as a replenishing solution. Further to 1 liter of the developing solution, 20 ml of the following starter was added and the pH was adjusted to 10.00 to make a working solution.

| Starter: | |
|---|---|
| Glacial acetic acid | 2.98 g |
| Potassium bromide | 4.0 g |
| Water to make | 1 liter |
| Preparation of fixing solution | |
| Fixer concentrated solution: | |
| Water | 260 g |
| Sodium sulfite | 16.7 g |
| Boric acid | 5 g |
| β-Alanine | 30 g |
| Sodium acetate | 13 g |
| Acetic acid | 19 g |
| Chelating agent (exemplified compd. 3-1) | 8.2 g |
| Aluminum sulfate | 3 g |
| Ammonium thiosulfate (70% aq. solution) | 260 g |

To the above concentrated fixer solution was added tap water to make 1 liter. The pH was adjusted to 4.4 with sulfuric acid and sodium hydroxide. The resulting solution was used as a working solution or replenishing solution.

Preparation of solid processing composition

According to the following procedure (A) and (B) was prepared a solid developing composition in the form of a tablet for use as a replenisher.

Procedure (A):

A developing agent of 3,000 g, as shown in Table 2 was pulverized up in a commercially available mill so as to have an average particle size of 10 μm. To the resulting fine particles were added sodium sulfite of 3,000 g, potassium sulfite of 2,000 g and 1-phenyl-3-pyrazolidone of 1,000 g and the mixture was mixed in the mill for 30 min. In stirring granulator commercially available, the resulting mixture was granulated for 10 min. at room temperature by adding 30 ml of water. The resulting granules were dried up at 40° C. for 2 hr. in a fluidized bed drier so that the moisture content of the granules was almost completely removed off. To the resulting granules, polyethylene glycol (#6000) of 1,000 g was added. Each of the granules was mixed for 10 min. by making use of a mixer in a room controlled to be not higher than 25° C. and 40% RH. The mixture was compression-tableted so as to have a filling amount of 3.64 g per tablet, by making use of a tableting machine that was modified model of Tough Press Collect 1527HU manufactured by Kikusui Mfg. Works, Inc. Thereby, 2500 tablets of developing composition (A) for use as replenisher were prepared.

Procedure (B):

A chelating agent as shown in Table 2, potassium carbonate of 4,000 g, 5-methylbenzotriazole of 10 g, 1-phenyl-5-mercaptotetrazole of 7 g, 2-mercaptohypoxanthine of 5 g, potassium hydroxide of 200 g and N-acetyl-D,L-penicilamine of 3 g each were pulverized and granulated in the same manner as in procedure (A). The addition amount of water was 300 ml, and after granulation, the resulting granules were dried up at 50° C. for 30 min. so that the moisture content of the granules was almost completely removed off. Further, the mixture was compression-tableted so as to have a filling amount of 1.77 g per tablet, by making use of a tableting machine that was modified model of Tough Press Collect 1527HU manufactured by Kikusui Mfg. Works, Inc to obtain 2,500 tablets of developing composition (B) in the form of a tablet for use as replenisher.

According to the following procedure, was prepared a solid fixing composition in the form of a tablet for use as a replenisher.

Procedure (C):

Ammonium thiosulfate/sodium thiosulfate (70/30 by weight ratio) of 14000 g, sodium sulfite of 1,500 g, and chelating agent of the invention of 300 g each were pulverized and then mixed with each other in a commercially available mixer. The resulting mixture was granulated with addition of water of 500 ml, in the same manner as in procedure (A). To the resulting granules, sodium N-lauroylalanine of 4 g was added. The granules were compression-tableted so as to have a filling amount of 6.32 g per tablet, by making use of a tableting machine that was modified model of Tough Press Collect 1527HU manufactured by Kikusui Mfg. Works, Inc. Thereby, 2500 tablets of fixing composition (C) for use as replenisher were prepared.

Procedure (D):

Boric acid of 1,000 g, aluminum sulfate octadecahydrate of 1,500 g, sodium hydrogenacetate (equimolar mixture of acetic acid and sodium acetate) of 1,500 g and tartaric acid of 200 g each were pulverized and granulated in the same manner as in procedure (A). The addition amount of water was 100 ml, and after granulation, the resulting granules were dried up at 50° C. for 30 min. so that the moisture content of the granules was almost completely removed off. Further, sodium N-lauroylalanine of 4 g was added and mixing was carried out for 3 min. The mixture was compression-tableted so as to have a filling amount of 4.562 g per tablet, by making use of a tableting machine that was modified model of Tough Press Collect 1527HU manufactured by Kikusui Mfg. Works, Inc to obtain 1,250 tablets of fixing composition (D) in the form of a tablet for use as replenisher.

At the time of starting processing (running process), 412 tablets of developing composition (A) and 824 tablets of developing composition (B) were dissolved in water to make 16.5 liters of developing solution.

To the developing solution, 330 ml of afore-described starter was added to make a developer-starting solution.

Photographic materials (X-ray film for medical use, SR-G, produced by Konica corp.) were exposed so as to give a density of 1.0 and subjected to running-processing. Processing was carried out using an automatic processor, SRX-502, which was provided with a input member of a solid processing composition and modified so as to complete processing in 30 sec. A developer bath and fixer bath each were provided with two dissolution baths with a capacity of 2 liter and a replenishing member from these two dissolution baths to the processing baths was also provided. During running-processing, in cases where a developer and a fixer replenishing solutions which were each prepared from a developer and fixer concentrated solutions were employed, the developer and fixer replenishing rates were each 130 ml/m$^2$. In cases where solid developing composition in the form of a tablet was employed as a replenisher, tablets (A) and (B), each 2 tablets and 76 ml of water per 0.62 m$^2$ of the photographic material were added to the developer dissolution bath. When each of the tablets (A) and (B) was dissolved in water of 38 ml, the pH was 10.70.

In cases where the solid fixing composition was employed as a replenisher, 2 tablets of (C) and 1 tablet of (D) per 0.62 m$^2$ with 74 ml of water were added to the fixer dissolution bath. The replenishing rate of from the dissolution bath to the processing bath was 80 ml per 0.62 m$^2$ of the photographic material Addition of water was started at the same time of that of the tablets and continued at a constant rate further for 10 min. in proportion to a dissolving rate of the solid processing composition.

| Processing condition: | | |
|---|---|---|
| Developing: | 35° C. | 9.8 sec. |
| Fixing: | 33° C. | 6.0 sec. |
| Washing: | Ordinary temp. | 5.4 sec. |
| Squeegee: | | 1.9 sec. |
| Drying: | 40° C. | 6.9 sec. |
| Total | | 30.0 sec. |

Comparative processing:

For the purpose of comparison, processing was conducted at a developing temperature of 35° C., fixing temperature of 33° C. and washing temperature of 20° C. for a total time of 30 or 45 sec., using the following processing solutions. In the case when processed for 30 sec., the developer and fixer replenishing rates were each 130 ml/m$^2$. In the case when processed for 45 sec., the developer and fixer-replenishing rates were respectively 278 ml/m$^2$ and 420 ml/m$^2$.

| Developing solution | |
|---|---|
| Part-A: | |
| Potassium hydroxide | 37.5 g |
| Potassium sulfite (50% aq. solution) | 190 g |
| Chelating agent as shown in Table 2 | |
| Sodium hydrogencarbonate | 11 g |
| 5-Methylbenzotriazole | 0.1 g |
| 1-Phenyl-5-mercaptotetrazole | 0.02 g |
| Developing agent (hydoquinone or 1-1) | 30 g |
| Part-B: | |
| Glacial acetic acid | 14 g |
| Triethylene glycol | 15 g |
| 1-Phenyl-3-pyrazolidone | 1.8 g |
| 5-Nitroindazole | 0.03 g |
| Starter | |
| Glacial acetic acid | 120 g |
| Potassium bromide | 225 g |
| Water to make | 1 liter |
| **Fixing solution** | |
| Part-A | |
| Ammonium thiosulfate (70 wt./vol. %) | 333 g |
| Sodium sulfite | 6 g |
| Sodium acetate trihydrate | 25 g |
| Sodium citrate | 2.8 g |
| Gluconic acid | 3.9 g |
| 1-(N,N-dimethylamino)-ethyl-5-mercaptotetrazole | 1 g |
| Part-B | 44 g |
| Aluminum sulfate | |

Preparation of developing solution

Part-A and B were simultaneously added into water with stirring and water was further added thereto to make 1 liter. The pH was adjusted to 10.40 with glacial acetic acid and potassium hydroxide and the resulting developing solution was used as a replenisher. To 1 liter of the developing solution, 20 ml of the starter was added to make a working developer solution with a pH of 10.26.

Preparation of fixing solution

Part-A and B were simultaneously added into water with stirring and water was further added thereto to make 1 liter. The pH was adjusted to 4.4 with sulfuric acid and potassium hydroxide and the resulting fix solution was used as a working solution a replenishing solution.

Test of biodegradability of chelating agents

Biodegradability of conventionally used chelating agents including ethylenediaminetetracetic acid (EDTA), diethylenetriaminepentaacetic acid (DTPA) and N-hydroxyethylethylenediaminetriacetic acid (HEDTA), and exemplified compounds 2-1, 2-3, 3-1 and 3-2 were each tested in accordance with 301C modified MITI Test (1) of OECD Chemicals Test Guideline (adopted in May 12, 1981). Degree of biodegradation was shown as a relative value, based on that of compound 3-1 ([S,S] isomer) being 100(%).

TABLE 1

| Chelating agent | Biodegradability (%) | Remarks |
|---|---|---|
| EDTA | 4 | Comp. |
| DTPA | 3 | Comp. |
| HEDTA | 6 | Comp. |
| 2-1 | 96 | Inv. |
| 2-2 | 94 | Inv. |
| 3-1 | 96 | Inv. |
| 3-1* | 100 | Inv. |
| 3-2 | 96 | Inv. |

*: [S,S] isomer

As can be seen from Table 1, chelating agents of the invention were marked in degradability. Specifically, the use of [S,S] isomer led to enhanced degradation. Conventionally used chelating agents, EDTA, DTPA and HEDTA were shown to be considerably poor in degradability.

Evaluation of process stability:

According to the above-described processing, X-ray films for medical use, SR-G with a size of 254×305 mm (product by Konica Corp.) were subjected to running-processing, in which the X-ray films were exposed so as to give a density of 1.0 and 100 sheets of the films were processed every day. At the 1st day and 30th day of the running-processing, sensitometry was conducted in the following manner to evaluate process variation.

The films were sandwiched between fluorescent screens SRO-250 (product by Konica Corp.) and exposed to X-ray emitted at a bulb voltage of 90 kVP and 20 mA for 0.05 sec. Sensitivity, fog and gamma (i.e., average contrast between a density of fog plus 0.25 and a density of fog plus 2.0) were each determined based on a sensitometry curve prepared by a distance method. The sensitivity was shown as a relative value of reciprocal of exposure necessary for giving a density of fog plus 1.0, based on that at the start of processing being 100.

Evaluation of precipitation due to metal ions

To evaluate effectiveness of a chelating agent, calcium ions of 200 ppm and magnesium ions of 4200 ppm were added to developing solution samples 1 through 13. After the developing solutions were allowed to stand at room temperature for a period of 7 days, smudge due to precipitation occurred in a developing tank and roller was visually observed, based on the following evaluation criteria.

A: No precipitation occurred

B: Slight precipitation occurred

C: Apparent precipitation occurred

Results thereof are shown in Table 2

TABLE 2

| Sample No. | Form of developer | Developing agent | Processing time (sec.) | Chelating agent (mol/l) | | Sensitivity 1st day | Sensitivity 30th day | Gamma 1st day | Gamma 30th day | Fog 1st day | Fog 30th day | Precipitation | Remarks |
|---|---|---|---|---|---|---|---|---|---|---|---|---|---|
| 1 | Liquid | HQ* | 45 | — | | 100 | 73 | 2.85 | 2.60 | 0.08 | 0.08 | C | Comp. |
| 2 | Liquid | HQ | 45 | EDTA | (0.01) | 100 | 87 | 2.85 | 2.70 | 0.15 | 0.15 | B | Comp. |
| 3 | Liquid | HQ | 30 | EDTA | (0.01) | 100 | 80 | 2.85 | 2.65 | 0.13 | 0.14 | B | Comp. |
| 4 | Liquid | HQ | 45 | NTP | (0.01) | 100 | 82 | 2.85 | 2.65 | 0.14 | 0.14 | B | Comp. |
| 5 | Liquid | HQ | 45 | HEDP | (0.01) | 100 | 77 | 2.85 | 2.65 | 0.03 | 0.03 | C | Comp. |
| 6 | Liquid | 1-1 | 45 | — | | 97 | 72 | 2.80 | 2.60 | 0.10 | 0.10 | B | Comp. |
| 7 | Liquid | 1-1 | 45 | EDTA | (0.01) | 100 | 90 | 2.80 | 2.70 | 0.16 | 0.16 | B | Comp. |
| 8 | Liquid | 1-1 | 30 | EDTA | (0.01) | 100 | 88 | 2.80 | 2.65 | 0.15 | 0.15 | B | Comp. |
| 9 | Liquid | 1-1 | 45 | NTP | (0.01) | 99 | 85 | 2.80 | 2.65 | 0.14 | 0.14 | B | Comp. |
| 10 | Liquid | 1-1 | 45 | HEDP | (0.01) | 98 | 88 | 2.80 | 2.65 | 0.03 | 0.03 | B | Comp. |
| 11 | Liquid | 1-1 | 30 | 2-1 | (0.01) | 100 | 97 | 2.85 | 2.80 | 0.03 | 0.04 | A | Inv. |
| 12 | Liquid | 1-1 | 30 | 3-1 | (0.01) | 100 | 97 | 2.85 | 2.80 | 0.04 | 0.04 | A | Inv. |
| 13 | Solid | 1-1 | 30 | 3-1** | (0.01) | 100 | 98 | 2.85 | 2.80 | 0.03 | 0.03 | A | Inv. |
| 14 | Solid | 1-1 | 30 | 3-1 | (0.01) | 100 | 98 | 2.85 | 2.80 | 0.03 | 0.04 | A | Inv. |
| 15 | Solid | 1-1 | 30 | 3-2 | (0.01) | 100 | 98 | 2.80 | 2.75 | 0.04 | 0.04 | A | Inv. |

*: Hydroquinone
**: [S,S] isomer

As can be seen from Table 2, inventive samples were shown to be little variation in running-process with respect to sensitivity, fog and gamma, leading to stable photographic performance. Specifically, it is noted that the use of chelating agents of the invention prevented effectively precipitation occurred in a developing solution in the presence of metal ions.

To evaluate effectiveness of a chelating agent on a fixing solution, chelating agents as shown in Table 3 were added to the fixing solution in an amount of 0.01 mol/l. After adding thereto calcium ions of 200 ppm and magnesium ions of 4200 ppm and being allowed to stand at room temperature for a period of 7 days, smudge due to precipitation occurred in a developing tank and roller was visually observed, based on the following evaluation criteria.

A: No precipitation occurred

B: Slight precipitation occurred

C: Apparent precipitation occurred

Results thereof are shown in Table 3

TABLE 3

| Sample No. | Chelating agent | Precipitation | Remarks |
|---|---|---|---|
| 1 | — | C | Comp. |
| 2 | EDTA | B | Comp. |
| 3 | 2-1 | A | Inv. |
| 4 | 2-2 | A | Inv. |
| 5 | 3-1 | A | Inv. |
| 6 | 3-1* | A | Inv. |
| 7 | 3-2 | A | Inv. |

*: [S,S] isomer

As can be seen from Table 3, the use of chelating agents of the invention prevented effectively precipitation occurred in a fixing solution with metal ions.

What is claimed is:

1. A developing composition for a silver halide black-and-white photographic light sensitive material comprising a compound represented by formula (1) and a compound represented by formula (2) or (3):

formula (1)

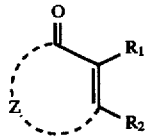

wherein $R_1$ and $R_2$ are each independently a hydroxy group, mercapto group, an amino group, an acylamino group, an alkylsulfonylamino group, an arylsulfonylamino group, an alkoxycarbonylamino group, or an alkylthio group; Z is an atomic group necessary for forming a 5 or 6-membered ring;

formula (2)

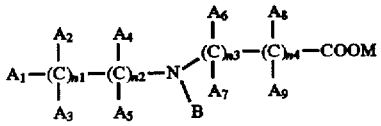

wherein, B is a hydrogen atom or OH; when B is a hydrogen atom, $A_1$ through $A_9$ is each independently a hydrogen atom, OH, $C_nH_{2n+1}$ or $(CH_2)_mX$, in which n is an integer of 1 to 3, m is an integer of 0 to 3 and X is $COOM_1$, $NH_2$ or OH, $n_1$ and $n_2$ are each 1 and $n_3$ plus $n_4$ is an integer of 1 to 4, provided that all of $A_1$ to $A_5$ are not hydrogen atoms; when B is OH, $n_1$ and $n_2$ are an integer, provided that $n_1$ plus $n_2$ is 2, $n_3$ is 0 and $n_4$ is 1, $A_1$, $A_8$ and $A_9$ are each a hydrogen atom, $A_2$ through $A_5$ are each independently a hydrogen atom, OH, $COOM_1$, $PO_3(M_1)_2$, $CH_2COOM_1$, $CH_2OH$ or an lower alkyl group, provided that at least one of $A_2$ through $A_5$ is $COOM_1$, $PO_3(M_1)_2$ or $CH_2COOM_1$; M and $M_1$ are each a hydrogen atom, an alkali metal atom or an ammonium group.

formula (3)

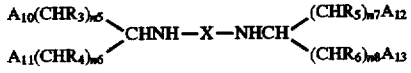

wherein $A_{10}$ through $A_{13}$ are each $COOM_2$ or OH; $n_5$ through $n_8$ are each an integer of 0 to 3; $R_3$ through $R_6$ are each independently a hydrogen atom, OH or a lower alkyl group; X is an alkylene group having 2 to 6 carbon atoms or $=(B_1O)_{m1}—B_2—$, in which $B_1$ and $B_2$ are each an alkylene group having 1 to 5 carbon atoms and $m_1$ is an integer of 1 to 5; $M_2$ is a hydrogen atom, an alkali metal atom or an ammonium group.

2. The developing composition of claim 1, wherein said composition is liquid or solid.

3. The developing composition of claim 2, wherein said solid developing composition is in the form of a tablet.

4. The developing composition of claim 1, wherein at least 70% of said compound represented by formula (2) or (3) is accounted for by its [S,S] optical isomer.

5. A developing solution for a silver halide black-and-white photographic light sensitive material comprising a compound represented by formula (1) and a compound represented by formula (2) or (3):

formula (1)

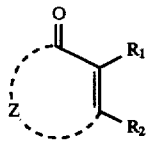

wherein $R_1$ and $R_2$ are each independently a hydroxy group, mercapto group, an amino group, an acylamino group, an alkylsulfonylamino group, an arysulfonylamino group, an alkoxycarbonylamino group, or an alkylthio group; Z is an atomic group necessary for forming a 5 or 6-membered ring;

formula (2)

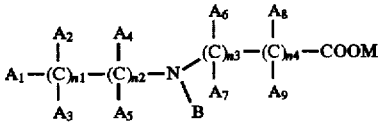

wherein, B is a hydrogen atom or OH; when B is a hydrogen atom, $A_1$ through $A_9$ is each independently a hydrogen atom, OH, $C_nH_{2n-1}$ or $(CH_2)_mX$, in which n is an integer of 1 to 3, m is an integer of 0 to 3 and X is $COOM_1$, $NH_2$ or OH, $n_1$ and $n_2$ are each 1 and $n_3$ plus $n_4$ is an integer of 1 to 4, provided that all of $A_1$ to $A_5$ are not hydrogen atoms; when B is OH, $n_1$ and $n_2$ are each an integer, provided that $n_1$ plus $n_2$ is 2, $n_3$ is 0 and $n_4$ is 1, $A_1$, $A_8$ and $A_9$ are each a hydrogen atom, $A_2$ through $A_5$ are each independently a hydrogen atom, OH, $COOM_1$, $PO_3(M_1)_2$, $CH_2COOM_1$, $CH_2OH$ or an lower alkyl group, provided that at least one of $A_2$ through $A_5$ is $COOM_1$, $PO_3(M_1)_2$ or $CH_2COOM_1$; M and $M_1$ are each a hydrogen atom, an alkali metal atom or an ammonium group, formula (3)

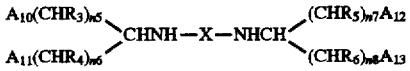

wherein $A_{10}$ through $A_{13}$ are each $COOM_2$ or OH; $n_5$ through $n_8$ are each an integer of 0 to 3; $R_3$ through $R_6$ are each independently a hydrogen atom, OH or a lower alkyl group; X is an alkylene group having 2 to 6 carbon atoms or $=(B_1O)_{m1}—B_2—$, in which $B_1$ and $B_2$ are each an alkylene group having 1 to 5 carbon atoms and $m_1$ is an integer of 1 to 5; $M_2$ is a hydrogen atom, an alkali metal atom or an ammonium group.

6. The developing solution of claim 5, wherein said developing solution has a pH of 9.5 to 10.5.

* * * * *